United States Patent [19]

Petropoulsos et al.

[11] 4,148,536

[45] Apr. 10, 1979

[54] SAFETY ELECTRICAL RECEPTACLE

[76] Inventors: Nikolaostzakos J. Petropoulsos, 7, Cazanova St., Piraeus; George D. Carvouniaris, 2, Terpsihoris St., Neo Eraclion, Athens, both of Greece

[21] Appl. No.: 853,881

[22] Filed: Nov. 22, 1977

[30] Foreign Application Priority Data

Nov. 22, 1976 [GR] Greece ..... 56353

[51] Int. Cl.[2] ..... H01R 13/44

[52] U.S. Cl. ..... 339/42; 200/51.09

[58] Field of Search ..... 339/40, 42, 36, 111; 200/51.09

[56] References Cited

U.S. PATENT DOCUMENTS 2,735,906 2/1956 Avrunin ..... 200/51.09

FOREIGN PATENT DOCUMENTS 2330401 11/1974 Fed. Rep. of Germany ..... 200/51.09

*Primary Examiner*—Neil Abrams

*Attorney, Agent, or Firm*—Cushman, Darby & Cushman

[57] ABSTRACT

An electric socket which is energized only upon insertion of plug contact fingers (prongs). The receptacle includes an insulative member having a leg portion on which one of the power line connectors is disposed. The insulative member is spring biased to a position wherein the connector is out of electrical contact with a contact arm connected to one of the receptacle spring arms adapted to contact the plug contact fingers. Thus, in the absence of the plug contact fingers, the receptacle is unenergized. When the plug contact fingers are inserted, they push the insulative member in a rearward direction to establish contact between the contact arm and power line connector, thereby energizing the receptacle.

4 Claims, 2 Drawing Figures

SAFETY ELECTRICAL RECEPTACLE

BACKGROUND OF THE INVENTION

The present invention relates to electrical receptacles (sockets) for receiving the contact fingers (prongs) of an electric plug to provide an electrical connection between the contact fingers and the respective conductors of a power line.

It is desirable that an electrical receptacle provide protection against accidental shocks. For example, accidental shocks often occur due to touching exposed portions of the plug contact fingers during the act of inserting the plug into, or withdrawing the plug from the receptacle. Accidental shocks also commonly occur when, for example, an infant attempts to insert a finger or some other foreign object into the receptacle.

Various receptacles have been proposed which address the problem of accidental shocks. Examples of such receptacles are described in U.S. Pat. Nos. 2,441,643 issued May 18, 1948 to Mickler, 3,909,566 issued Sep. 30, 1975 to Morrison et al, 2,735,906 issued Feb. 21, 1956 to Avrunin, 2,986,612 issued to Healy and Italian Pat. Nos. 647,602 (1962), 584,739 (1958), and 562,896 (1957). The Avrunin patent describes a safety receptacle wherein resilient contact arms are set in a spring biased insulative block are normally isolated from the receptacle power contacts (poles). Insertion of the plug contact fingers into the socket depresses the insulative block and deforms the contact arms to bring them into contact with the poles. The Morrison et al patent describes a receptacle wherein the insertion of plug contact fingers through a carrier member, in which contact arms are fixed, depresses a spring loaded insulative member to unseat the contact arms from a seat. Electrical contact is thereafter established between the contact arms and the power poles by pulling outwardly on the plug and carrier. Italian Pat. No. 584,739 and the U.S. patent to Healy describe safety receptacles wherein the insertion of plug contact fingers depress a pin to close a resilient spring switch. The closing of the switch activates a solenoid to apply power to the contact springs. A non-conventional plug structure, however, is required, as well as rotation of the plug to provide electrical contact to the contact springs. Italian Pat. Nos. 647,602 and 562,896 are directed to safety receptacles which require rotation of the plug to effect contact. The Mickler patent describes a hinged safety receptacle which is normally recessed in the wall and covered. Such prior art safety receptacles are relatively complex, and expensive to manufacture.

The present invention provides a comparatively simple and inexpensive electric receptacle which is energized only upon complete insertion of the plug contact arms. At least one of the spring arms adapted to wipe the contact fingers (prongs) of the plug are connected to a further contact arm rather than to one of the connectors of the power line. A conductive connector or contact head, adapted to receive the power line conductor, is affixed to the leg of an insulative member disposed relative to the contact arm to permit the connector to contact the contact arm in response to a rearward movement of the leg, to thereby establish a connection between the power line conductor and the spring arm. The insulative member is spring biased into a position wherein the connector is out of contact with the contact arm. The insulative member is disposed in the receptacle such that when the contact fingers of the plug are inserted, the spring bias is overcome, and the rearward movement of the leg is effected to move the connector into electrical engagement with the contact arm. The tension or friction exerted on the contact fingers by the spring arms is sufficient to retain the plug in position, as against the spring bias, until the plug is withdrawn from the receptacle. The relative dispositions of the insulative member leg and contact arm are preferably such that the spring arms are not energized until the contact fingers of the plug are fully inserted into the receptacle. In such instance, the receptacle is de-energized upon initiating withdrawal of the contact fingers, thus avoiding the possibility of accidental shock through the exposed contact fingers.

A preferred exemplary embodiment of the present invention will now be described with reference to the accompanying drawing, wherein like numerals denote like elements and;

FIG. 1 is a sectional elevation of a receptacle in accordance with the present invention in an unenergized state; and FIG. 2 is a sectional elevation of a receptacle in accordance with the present invention in an activated state.

DETAILED DESCRIPTION OF THE EMBODIMENT

Figure 2:
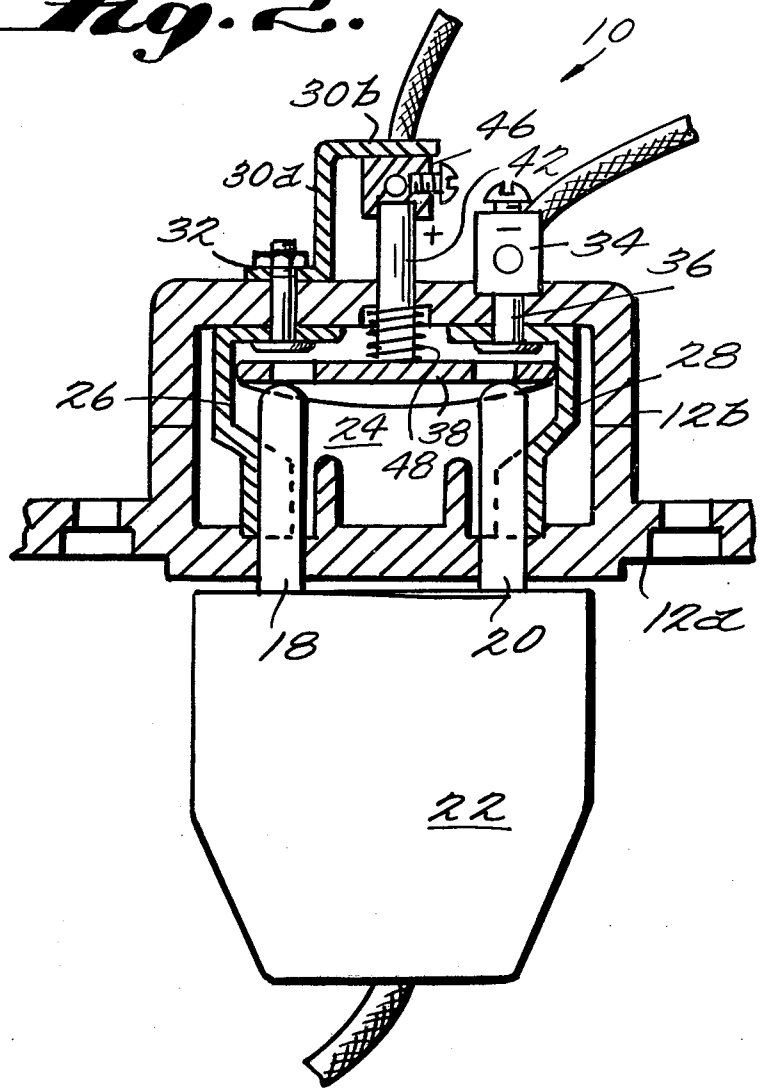
Figure 1:
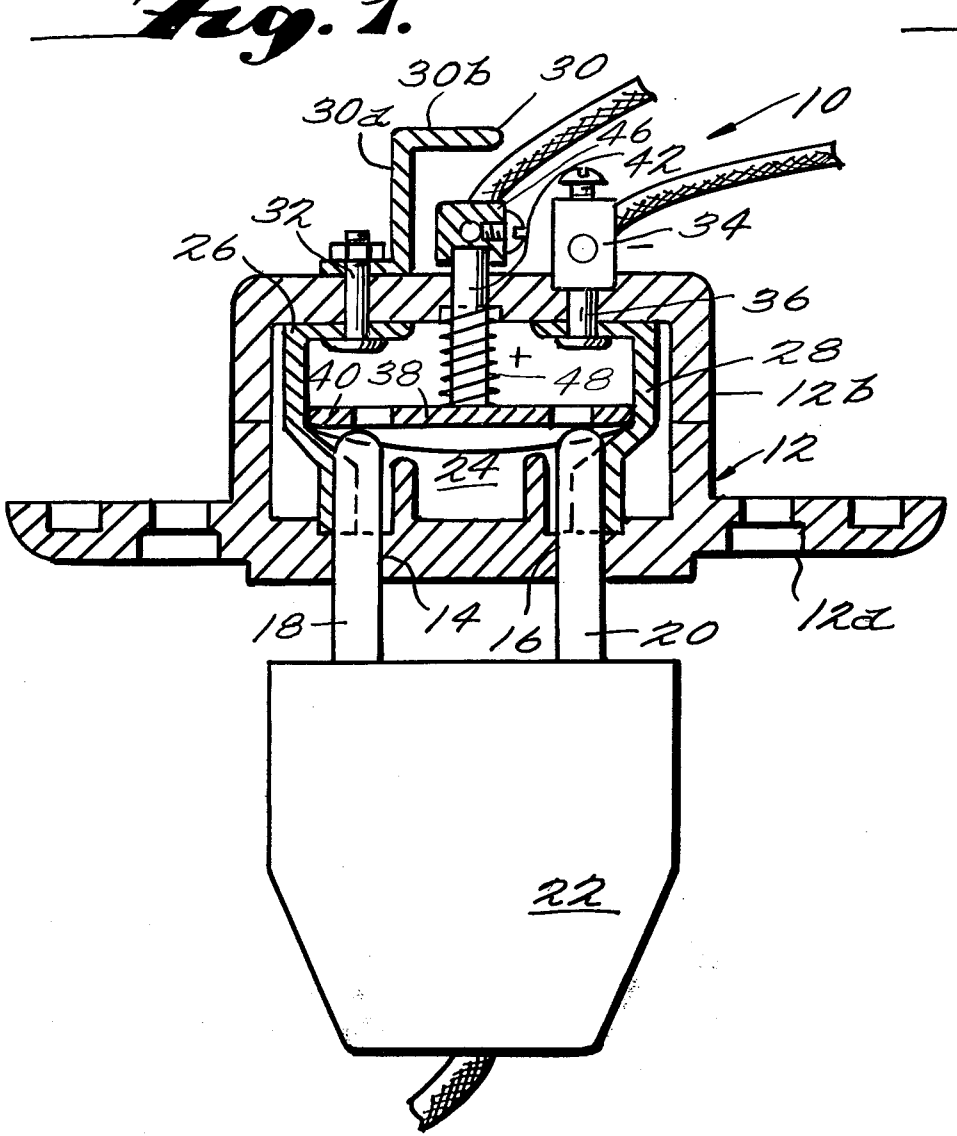

Referring now to FIGS. 1 and 2, there is shown a receptacle in accordance with the present invention, generally indicated as 10, a frame or housing 12 is provided, suitably formed of a face piece 12*a* and rear portion 12*b*. Housing 12 is suitably formed of a non-conductive material such as plastic or ceramic, and is of dimensions in accordance with international specifications, that is, having similar outward appearance and dimensions with conventional electric receptacles available on the market. Portions 12*a* and 12*b* may be affixed to each other in any suitable manner such as by snap-fitting, gluing, or by a fastener (not shown). Face plate 12*a* includes apertures 14 and 16, of dimensions to closely admit contact arms (prongs) 18 and 20 of a plug 22. When fitted together, housing portions 12*a* and 12*b* create an interior compartment 24. Conductive spring arms 26 and 28 suitably formed of bronze, are disposed within compartment 24, such that a wiping contact is provided against contact fingers 18 and 20. Spring arm 26 is secured, and electrically connected to a further contact arm 30 by a conductive fastener 32, suitably a bolt and nut or rivet, passing through an aperture in rear portion 12*b* of housing 12. Contact arm 30 is suitably formed of bronze. Spring arm 28 is similarly secured, and electrically connected to a connector 34, adapted to receive a power line conductor (the negative line) by a screw or bolt 36 passing through an aperture in housing portion 12*b* and engaging corresponding threads in connector 34.

A member 38 formed of insulating material and having a base portion 40 and leg 42 is disposed within compartment 24 with leg 42 extending through an aperture 44 in housing portion 12*b*. A second connector or contact head 46, formed of a conductive material such as bronze, is affixed to the end of insulative leg 42, external to compartment 24, suitably by threading. Connector 46 is adapted to receive a further power line conductor, preferably the positive line.

Insulative member 38 is disposed relative to contact arm 30 to permit connector 46 to electrically engage the contact arm 30 in response to a rearward motion of leg 42. For example, in the preferred embodiment, the apertures through which fasteners 32 and 36 pass are aligned with apertures 14 and 16 in the face plate 12*a*. Aperture 44 is centrally located therebetween. Contact arm 30 is bent to have a portion 30*a* disposed in parallel to the motion of leg 42 and a bent over portion 30*b* disposed divergent to the direction of motion, preferably perpendicular thereto, and extending into the path of connector 46. Spring arms 26 and 28 are configured to allow free movement of insulative member 38. Stand-offs can be included on the rear portion of face plate 12*a* to define limits to the forward excursion of insulative member 38. The respective lengths of contact arm portion 30*a*, leg 42, and connector 46 are chosen in accordance with the standardized length of contact fingers 18 and 20 such that the connector 46 does not engage contact arm 30 until the contact fingers are substantially fully inserted.

Insulative member 38, however, is biased, suitably by a spring 48 disposed about leg 42 and engaging housing portion 12*b*, into a position wherein connector 46 is out of contact with contact arm 30. Thus, receptacle 10 is normally unenergized. Such a position is illustrated in FIG. 1. Spring 48 is suitably formed of steel, and chosen such that the friction or tension on contact fingers 18 and 20 by spring arms 26 and 28 is sufficient to secure plug 22 in an engaged position, until extrinsically withdrawn.

When contact arms 18 and 20 are inserted through apertures 14 and 16, they engage base 40 of insulative member 38 and proceed to effect rearward movement of leg 42 and connector (contact head) 46, ultimately causing connector 46 to engage contact arm portion 30*b*. When such contact is made, a circuit is completed between the power line and contact fingers 18 and 20.

It should be noted that since connector 46 does not engage contact arm 30 to energize the circuit until contact fingers 18 and 20 are substantially totally inserted into the receptacle, accidental shocks due to touching exposed portions of the contact fingers during insertion of the plug are prevented. Similarly, since contact 46 is disengaged from contact arm 30 almost immediately upon initiating withdrawal of the plug, accidental shocks cannot occur due to touching exposed portions of contact fingers 18 and 20 during the process of withdrawing plug 22. Further, an infant cannot be shocked by inserting his fingers or commonly found household articles into apertures 14 and 16 in view of the normally unenergized state of the receptacle.

It should be appreciated, that while a bipolar receptacle is shown, that is for a two-prong plug, the receptacle can easily be modified to accomodate further prongs or contact fingers such as a ground prong. Further, it should be noted that the external disposition of connectors 34 and 46 and contact arm 30 facilitate connection receptacle 10 to the power line. However, if desired, an additional non-conductive housing having an aperture to closely admit the power line, can be included to cover contact arm 30 and connectors 34 and 46.

It will be understood that the above description if of illustrative embodiments of the present invention, and that the invention is not limited to the specific form shown. Modifications may be made in the design and arrangement of the elements without departing from the spirit of the invention as expressed in the appended claims.

We claim:

1. A selectively energized receptacle for receiving an electric plug, and providing electrical connections between the contact fingers of said plug and the respective conductors of a power line comprising:

a frame, having apertures therein for admitting said plug contact fingers;

first and second electrical contacts, respectively non-conductively affixed to said frame, and disposed with respect to said frame apertures to electrically contact respective ones of said plug contact fingers admitted therethrough;

a first electrical connector, electrically coupled to one of said electrical contacts, adapted for electrical coupling to a first of said power line conductors;

a contact arm, non-conductively affixed to said frame and electrically connected to said second contact, said contact arm being disposed rearwardly of said frame apertures;

an insulative member, moveably attached to said frame, interposed between said apertures and said contact arm;

said insulative member being generally T-shaped, having a cross-bar portion and a central leg portion, said crossbar portion being disposed towards said frame apertures and adapted to cooperate with said plug contact fingers, said central leg portion being disposed towards said contact arm;

a second electrical connector, adapted for coupling to a second power line conductor, said second connector being affixed to the end of said insulative member central leg portion;

said insulative member being disposed to cooperate with said plug contact fingers such that admission of said contact fingers through said frame apertures moves said insulative member to place said second connector into contact with said contact arm to thereby establish said connection between said second power line conductor and said respective plug contact finger; and a spring cooperating with said insulative member and said frame, for biasing said insulative member to a position such that said second connector is out of contact with said contact arm, whereby said receptacle is unenergized in the absence of admitted plug contact fingers.

2. The receptacle of claim 1 wherein said frame forms a substantially closed unit; and a portion of said central leg portion extends outward through a further aperture in said frame;

said first and second connectors, and said contact arm being external to said closed unit to facilitate thereby connection to said power line conductors.

3. The receptacle of claim 2 wherein said first and second electrical contacts each comprise a conductive spring arm; and are respectively coupled to said first connector and said contact arm by conductive fasteners extending through said frame.

4. A receptacle for providing electrical connections between respective conductors of a power line and the contact fingers of a plug, comprising:

a non-conductive frame having a central open compartment and apertures adapted to admit said contact fingers into said compartment;

first and second conductive spring arms, disposed in said compartment and adapted to provide wiping electrical contact to said contact fingers as said contact fingers are admitted into said compartment;

a first electrical connector adapted to receive one of said power line conductors, disposed externally of said compartment and connected to said first spring arm by a conductive fastener passing through a portion of said frame;

a conductive contact arm, disposed externally of said compartment and connected to said second spring arm by a conductive fastener passing through a portion of said frame;

an insulative member disposed within said compartment, having a base portion and a leg portion, the end of said leg portion extending outwardly of said compartment;

a second electrical connector adapted to receive a power line conductor affixed to said insulative member leg end, said insulative member leg end being disposed relative said contact arm to permit said second connector to electrically contact said contact arm in response to rearward movement of said leg;

a spring, cooperating with said frame and said insulative member, to bias said insulative member into a first position wherein said second connector is out of contact with said contact arm, whereby said spring arms are unenergized;

said insulative member base portion being adapted to cooperate with said plug contact fingers such that admission of said contact fingers overcomes said spring bias and effects said rearward movement of said leg to establish contact between said second connector and contact arm to energize thereby said spring arms and provide connection of said contact fingers to said power line.

* * * * *

UNITED STATES PATENT AND TRADEMARK OFFICE

CERTIFICATE OF CORRECTION

PATENT NO. : 4,148,536

DATED : April 10, 1979

INVENTOR(S) : Nikolaostzakos J. Petropoulos and George D. Carvouniaris

It is certified that error appears in the above-identified patent and that said Letters Patent are hereby corrected as shown below:

In the inventors name change "Petropoulsos" to -- Petropoulos --.

Signed and Sealed this

Thirty-first Day of July 1979

[SEAL]

*Attest:*

*Attesting Officer*

LUTRELLE F. PARKER

*Acting Commissioner of Patents and Trademarks*